US006453586B1

(12) United States Patent
Wolin et al.

(10) Patent No.: US 6,453,586 B1
(45) Date of Patent: Sep. 24, 2002

(54) BUCKET ASSEMBLY

(76) Inventors: Robert H. Wolin, 11121 Upper Previtali Rd., Jackson, CA (US) 95642; William E. Wolin, 10368 Argonaut Dr., Jackson, CA (US) 95642

( * ) Notice: Subject to any disclaimer, the term of this patent is extended or adjusted under 35 U.S.C. 154(b) by 0 days.

(21) Appl. No.: 09/534,151

(22) Filed: Mar. 23, 2000

(51) Int. Cl.[7] ..... E02F 3/96
(52) U.S. Cl. ..... 37/406; 414/739
(58) Field of Search ..... 294/88, 86.4, 106, 294/68.23; 37/406–461, 184, 185, 186, 187, 188, 403, 409, 410; 414/739–912

(56) References Cited

U.S. PATENT DOCUMENTS

| | | | | | |
|---|---|---|---|---|---|
| 2,725,996 | A | * | 12/1955 | Britton | 214/147 |
| 2,914,203 | A | * | 11/1959 | Gafner | 214/147 |
| 3,034,820 | A | * | 5/1962 | Schwartz et al. | 294/88 |
| 3,152,706 | A | * | 10/1964 | Conrad | 214/147 |
| 3,384,409 | A | * | 5/1968 | Guinot | 294/88 |
| 3,510,017 | A | * | 5/1970 | Guinot | 37/403 |
| 3,651,966 | A | * | 3/1972 | Willet | 214/147 |
| 3,877,743 | A | * | 4/1975 | Johnson | 294/88 |
| 4,017,114 | A | * | 4/1977 | Labounty | 294/88 |
| 4,023,848 | A | * | 5/1977 | Bennett | 294/88 |
| 4,248,471 | A | * | 2/1981 | LaBounty | 294/88 |
| 4,285,628 | A | * | 8/1981 | Jankowski | 414/739 |
| 4,372,063 | A | * | 2/1983 | Work | 37/409 |
| 4,375,345 | A | * | 3/1983 | Hanson | 414/722 |
| 4,382,625 | A | * | 5/1983 | LaBounty | 294/104 |
| 4,426,110 | A | * | 1/1984 | Mitchell et al. | 294/88 |
| 4,519,739 | A | * | 5/1985 | Risch | 414/724 |
| 4,542,929 | A | * | 9/1985 | Possinger | 294/88 |
| 4,799,852 | A | * | 1/1989 | Ramun | 414/724 |
| 4,848,703 | A | * | 7/1989 | Coulson et al. | 244/137.1 |
| 4,907,356 | A | * | 3/1990 | Labounty | 37/117.5 |
| 5,536,133 | A | * | 7/1996 | Velez et al. | 414/620 |
| 5,544,435 | A | * | 8/1996 | Somero | 37/405 |
| 5,715,614 | A | * | 2/1998 | Ookuwa et al. | 37/302 |
| 5,890,754 | A | * | 4/1999 | Murr | 294/107 |
| 5,927,933 | A | * | 7/1999 | Tucker | 414/729 |
| 5,964,050 | A | * | 10/1999 | Svahn | 37/409 |
| 5,971,455 | A | * | 10/1999 | Wolin et al. | 294/86.4 |
| 5,975,604 | A | * | 11/1999 | Wolin et al. | 294/88 |
| 6,120,237 | A | * | 9/2000 | Cummings | 414/729 |
| 6,126,216 | A | * | 10/2000 | Tollefson | 294/2 |
| 6,131,978 | A | * | 10/2000 | Rounds | 294/106 |
| 6,176,531 | B1 | * | 1/2001 | Wheeler | 294/88 |
| 6,202,331 | B1 | * | 3/2001 | Kobayashi | 37/403 |

FOREIGN PATENT DOCUMENTS

| | | | | |
|---|---|---|---|---|
| SU | 001715995 | * | 2/1992 | 37/406 |
| WO | 093016238 | * | 8/1993 | 37/406 |

* cited by examiner

*Primary Examiner*—Thomas B. Will
*Assistant Examiner*—Kristine Markovich
(74) *Attorney, Agent, or Firm*—L. E. Carnahan

(57) ABSTRACT

An tool adapted for attachment to a double pin mounting structure of the type that is commonly employed on excavator or backhoe type machines or vehicles. The tool is a bucket assembly with a grapple-like tine assembly mounted thereto and controlled by hydraulic actuators. The bucket assembly is mounted to a boom of a backhoe, for example, utilizing a single assembly composed of a hydraulic actuator and coupling members to attach to the double pin mounting structure on the tool. The bucket assembly is mounted on the boom to provide extended movement relative to the boom, and the grapple-like tine assembly is mounted to the bucket assembly for full closure and to enable near full opening relative to the bucket assembly. The tine assembly may be actuated by a pair of hydraulic actuators mounted adjacent one or both sides of the bucket assembly via a free floating bell crank for each pair of hydraulic actuators.

20 Claims, 6 Drawing Sheets

BUCKET ASSEMBLY

BACKGROUND OF THE INVENTION

The present invention relates to tools for heavy duty equipment such as backhoes or excavators, particularly to an improved bucket assembly for such equipment, and more particularly to a bucket assembly having a grapple like tine assembly mounted thereto and wherein the bucket assembly is mounted to an equipment boom via a double pin mounting structure and a single hydraulic actuator/linkage assembly.

Tools of various types are removably mounted on various types of heavy equipment utilized in construction, logging operations, demolition and other industrial fields. The tools are removably mounted on booms which are mounted on the equipment, generally of a wheeled or endless track type. The removable tools involved include buckets, grapples, earth compactors, hydraulic hammers, etc., and the equipment on which they are mounted employs a main boom pivotably mounted thereto with a dipper stick mounted on the end of a main boom to which the tool is removably attached. U.S. Pat. No. 5,975,604 issued Nov. 2, 1999 to R.H. Wolin et al describes and illustrates a grapple with a universal attachment mechanism which includes a double pin mounting structure.

The present invention constitutes an improvement over the grapple of the above referenced Patent No. 5,975,604 which comprises a bucket assembly having a grapple-like tine assembly mounted thereto and controlled by one or more pair of hydraulic actuators. The improved tool of the present invention is adapted to be mounted to a boom or dipper-stick of a piece of equipment or machine such as a backhoe or excavator, via a double pin mounting structure and a single actuator/linkage arrangement. The single actuator/linkage arrangement enables wider movement or swing of the tool than equipment utilizing dual actuator and/or linkage arrangements. The grapple-type tine assembly is constructed and mounted to the bucket assembly via a bell crank free floating about its axis which enables greater movement or opening of the tine assembly relative to the bucket assembly.

SUMMARY OF THE INVENTION

It is an object of the present invention to provide an improved removably mounted tool for equipment.

A further object of the invention is to provide an improved bucket assembly for removably mounting to equipment.

A further object of the invention is to provide a bucket assembly in combination with a grapple-like tine assembly.

Another object of the invention is to provide an improved bucket assembly removably mounted to a boom or dipper stick of a piece of equipment via a single actuator/linkage assembly to enable wider movement or rotation of the bucket.

Another object of the invention is to provide an improved bucket/tine assembly wherein the tine assembly is mounted to the bucket so as to enable near full extended movement relative to the bucket.

Another object of the invention is to provide a bucket/tine assembly which may be controlled by one or two pairs of hydraulic actuators, each pair of actuators being mounted via a free floating bell crank which is free floating about its axis.

Another object of the invention is to provide an improved bucket/grapple removably mounted to a boom or dipper stick of a piece of equipment via a single actuator/linkage assembly to enable wider movement or rotation of the bucket while having a continuous constant grasping force throughout the bucket rotation, which provides control and safety of material handling while providing increased movement of the bucket and grapple of the assembly.

Another object of the invention is to provide a bucket/grapple assembly removably mounted to a boom or dipper stick via a single actuator/linkage assembly to enable the bucket/grapple to perform grasping of material over a greater distance from the equipment on which the assembly is mounted.

Another object of the invention is to provide the equipment operator with fewer controls to operate the bucket/grapple assembly in that the grasping force of the assembly is activated by a common hydraulic circuit which is entirely independent of the single actuator/linkage assembly which changes the bucket rotation position relative to the dipper stick mounted on a boom of the equipment.

Another object of the invention is to provide the piece of equipment on which the bucket/grapple assembly is mounted with means to enable the bucket/grapple assembly to be dismounted from the dipper stick or boom by removal of two pins in a mounting structure.

Another object of the invention is to provide grapple movement in relation to the bucket so as to have the ability to open and close the same relationship in all positions of the bucket regardless of the bucket position in relation to the dipper stick or boom except when the bucket is nearly closed against the dipper stick or boom.

Other objects and advantages of the present invention will become apparent from the following description and accompanying drawings. The present invention is directed to an improved bucket assembly adapted to be removably mounted to a piece of equipment. The improved bucket assembly comprises a bucket in combination with a grapple-like tine assembly. The bucket assembly is constructed to be removably coupled to the equipment by a double pin mounting structure and by a single assembly composed of a hydraulic actuator and coupling or linkage members which enable a wider movement or rotation of the bucket assembly. The grapple-like tine assembly is movably mounted to the bucket via at least one bell crank which is free floating about its access and is controlled by at least one pair of hydraulic actuators. The tine assembly is mounted to the bucket to enable full closure and near full opening relative to the bucket.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

Figure 7:
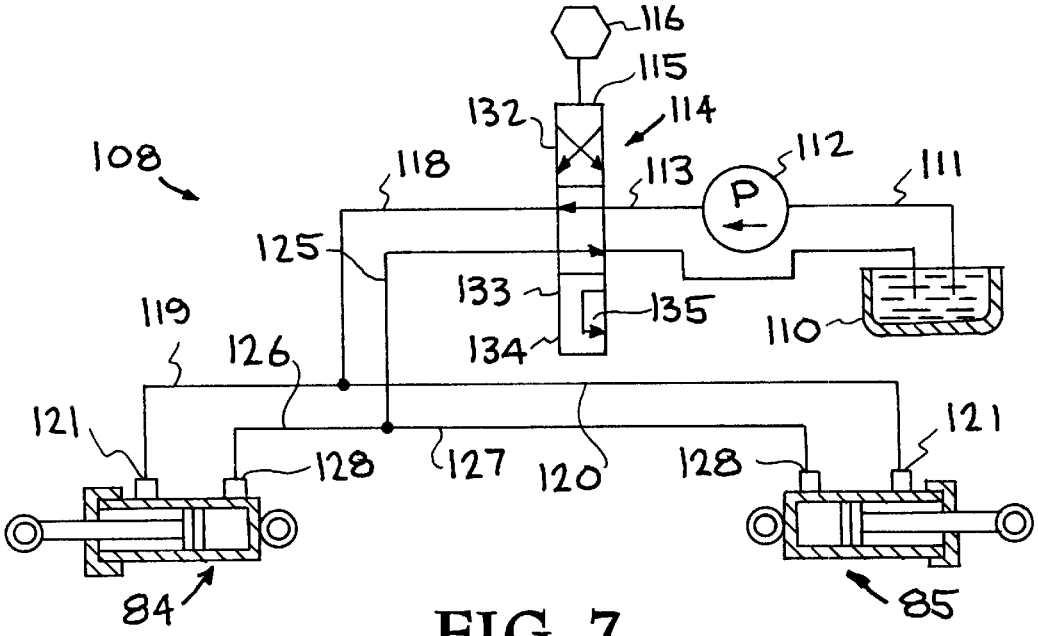
FIGS. 7 and 8 schematically illustrate control circuits for the single pair and double pair of hydraulic actuators.
Figure 8:
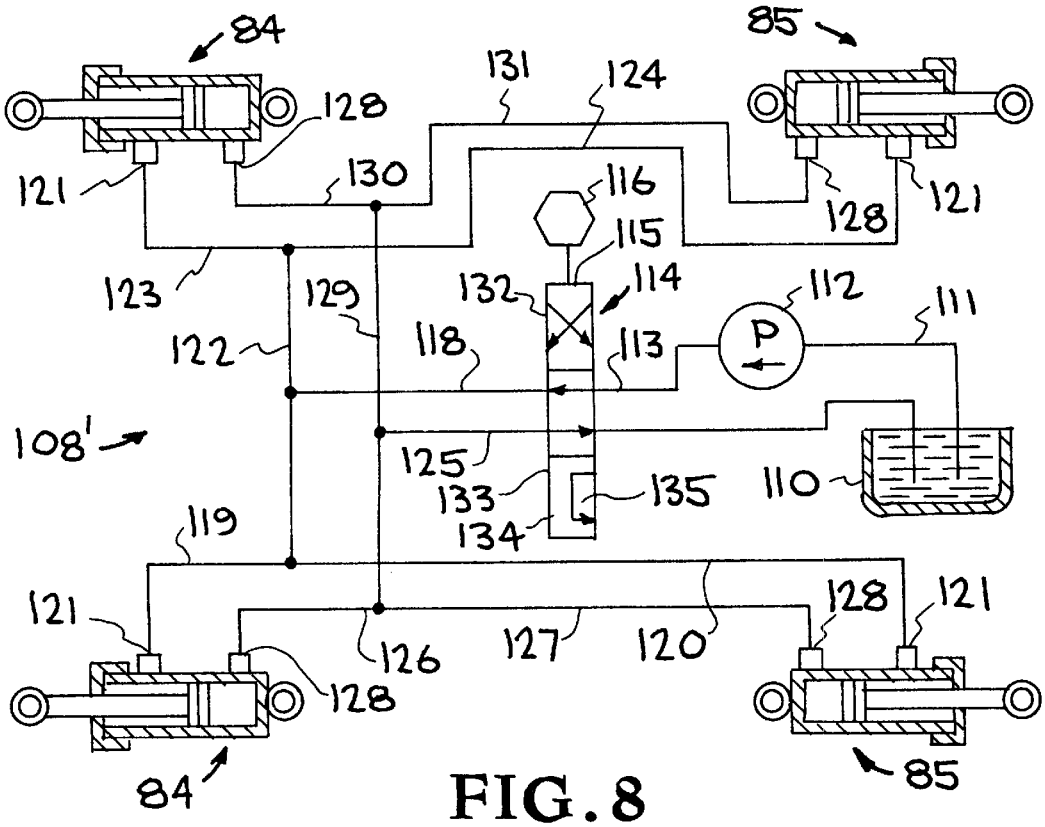

The present invention involves an improved bucket assembly for use with heavy equipment such as backhoes or excavators. The present invention comprises an improvement and modification over the grapple assembly of above referenced U.S. Pat. No. 5,975,604 (shown in FIG. 1) and each utilizes a double pin attachment structure for removably attaching to a boom or dipper stick of the equipment or machine on which it is to be utilized. The improved bucket assembly is attached to and controlled by a single actuator/linkage assembly mounted to the boom or dipper stick. By the use of the single actuator/linkage assembly, the improved bucket assembly has wider movement or rotation capabilities compared to buckets attached by dual boom/tool connector assemblies commonly utilized in the prior art. The grapple-like tine assembly of the improved bucket assembly is constructed and coupled to the bucket to enable full closure and nearly full opening relative to the bucket. The tine assembly is mounted and controlled via a pair of hydraulic actuators and a bell crank which is free floating about its axis mounted to the bucket, but two pair of hydraulic actuators and two bell cranks may be utilized. The control circuits for a pair and two pair of hydraulic actuators are illustrated in FIGS. 7 and 8.

Figure 1:
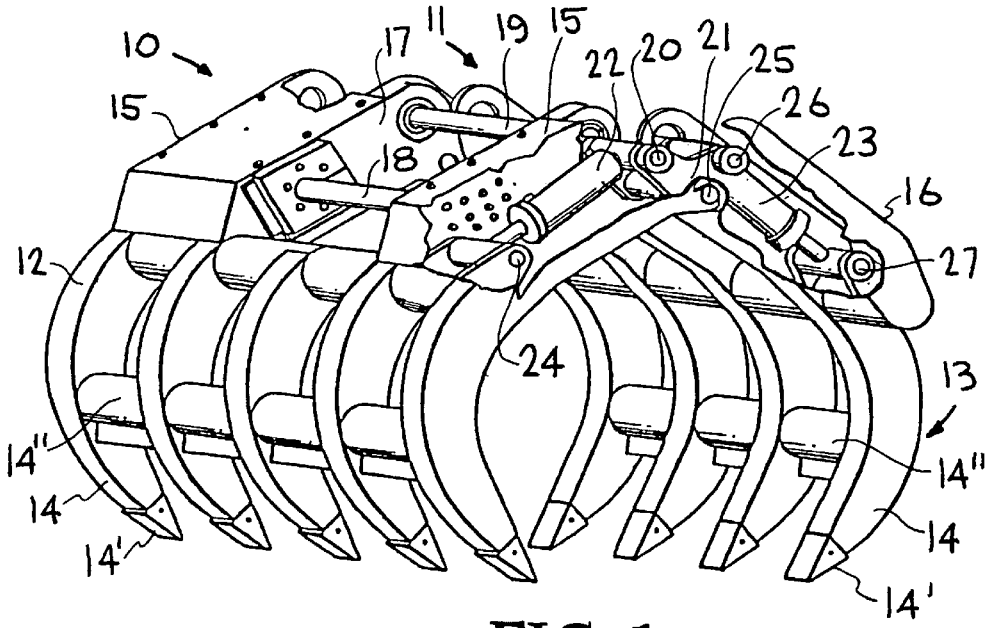
FIG. 1 (PRIOR ART)
FIG. 1 is a partially broken away perspective view of the grapple assembly of Patent No. 5,975,604.
Figure 2:
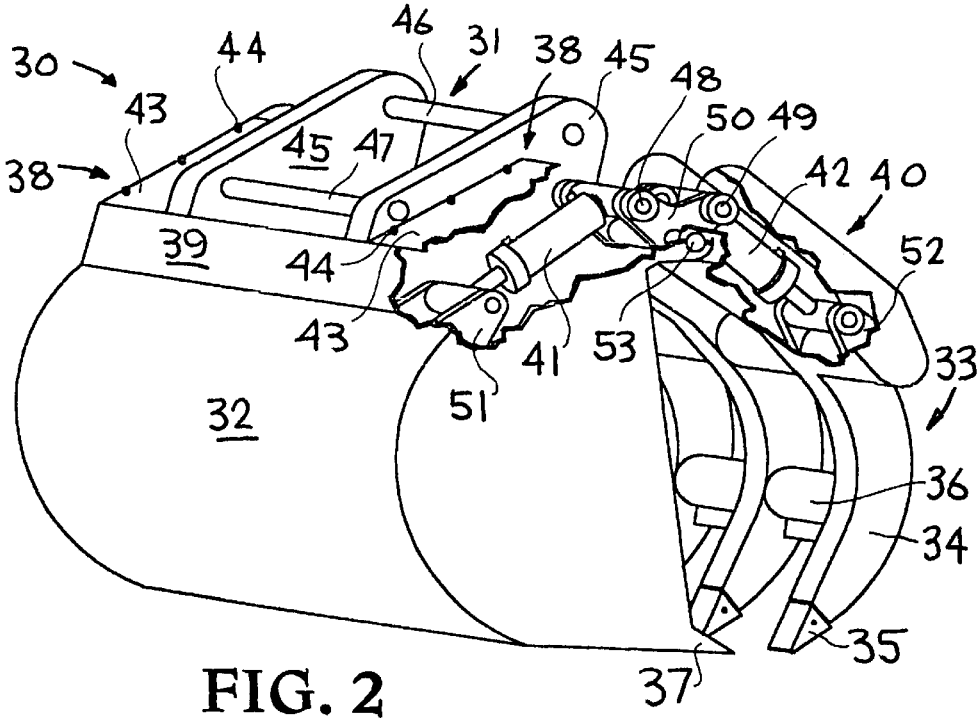
FIG. 2 is a partially broken away perspective view of an embodiment of the improved bucket assembly of the present invention.

Referring now to the drawings, FIG. 1 illustrates an embodiment of a grapple assembly disclosed in above referenced Patent No. 5,975,604 of which the present invention, an embodiment of which is shown in FIG. 2 and which comprises an improved bucket assembly, includes a grapple-like tine assembly with hydraulic actuators similar to a tine assembly and actuators of FIG. 1. Basically, it may be considered that the improved bucket assembly of FIG. 2 is a modification of the grapple assembly of FIG. 1 wherein a bucket replaces one set of tines. As in the grapple assembly of FIG. 1, the improved bucket assembly of FIG. 2 utilizes a double pin mounting structure. Thus, the improved bucket assembly is universal in application in that it is compatible for attachment with substantially all of the different double pin mounting systems in the industry and/or other types of mounting devices in the industry. The main and linkage pins of the bucket assembly can be easily changed at the job site using small hand tools. The bucket assembly of this invention can either be directly attached to the opening on the machine's boom or dipper stick, or it can be attached to a two pin quick coupler device available in the industry that may be in use on the boom.

The invention also enables the operator to have a greater degree of flexibility and more complete control over movement of the bucket assembly. The same control lever in the operator's compartment that would be used for rotating the excavating bucket through its range of movement is used to control the forward and reverse pitch of the grapple-like tine assembly through the same range of movement.

Because the mounting configuration of the invention is the same as the standard excavating bucket, the improved bucket assembly of the present invention can be used for light or heavy excavation work. Because the actuators for the bucket and tine assemblies may be located within a housing, the hydraulic lines from those actuators only need to be connected to the accessory control circuit of the machine. The location of the actuators, when not located within a housing, also protect the hydraulic cylinders and bell crank from damage.

As shown in FIG. 1, the grapple assembly, broadly described hereinafter and generally indicated at 10, includes a double pin mounting structure (generally indicated at 11) and two sets of grapple tines or members 12 and 13, the sets 12 and 13 in this embodiment having five and four tines indicated at 14, with tips 14' and separators 14". Two pair of actuator assemblies for the sets of tines are mounted within two housings 15–16 at each end of the sets of tines (only one housing 16 being shown), the double pin mounting structure 11 being located intermediate housings 15, with a wall 17 forming a common wall and in which pins 18 and 19 are mounted. The actuator assemblies mounted in housings 15–16 at each end of the sets of tines 12 and 13 (only one actuator assembly shown) basically includes a pin 20, a bell crank 21, and a pair of hydraulic actuators 22 and 23. Pin 20 is operatively mounted to bucket 32 and is pivotably connected to one segment or arm of bell crank 21, with hydraulic actuator 22 mounted intermediate pin 20 and a connector 24 mounted to grapple tine set 12. A central segment of bell crank 21 is pivotably mounted to grapple tine set 12 via a pin 25, and another segment or arm of bell crank 21 is pivotably mounted by pin 26 to hydraulic actuator 23 which is mounted to grapple tine set 13 via a connector 27. For further details of the FIG. 1 grapple assembly, reference is made to the above referenced Patent No. 5,975,604.

FIG. 2 illustrates an embodiment of the improved bucket assembly of the present invention and, which when compared to FIG. 1, basically involves replacement of one of the sets of tines with a bucket and a change in the construction of the double pin mounting structure. As shown, the FIG. 2 embodiment (generally indicated at 30) basically comprises a double pin mounting structure 31, a bucket 32 and a grapple-like tine assembly 33 having four tines 34 with tips 35 and spacer members 36, and constructed similar to the embodiment of tine set 13 in FIG. 1. Bucket 32 is provided with a plurality of tips 37 (only one shown in FIG. 2 but with five shown in FIG. 6). A pair of housings 38 are mounted to the bucket on each side of mounting structure 31 and include a common face or side plate 39. A pair of housings 40 are mounted to the tine assembly 33 (only one of which is shown) and within each set of housings 38 and 40 are mounted to hydraulic actuators 41 and 42 (only one set being shown). Housings 38 each include a removable top plate 43 retained by bolts or screws 44 which are secured to a member (not shown) adjacent support members 45 of mounting structure 31 which supports removable pins 46 and 47. Hydraulic actuators 41 and 42 are each pivotably mounted at one end to pins 48 and 49 which are mounted in legs of a bell crank assembly 50, with actuator 41 being pivotably mounted at the opposite end to bucket 32 by a connector assembly 51 and actuator 42 pivotably mounted at the opposite end to tine assembly 33 via a connector assembly 52. Bell crank assembly 50 is pivotably mounted on a pin 53 which is mounted to bucket 32 (as seen more clearly in FIG. 6). While not shown in FIG. 2, a corresponding hydraulic actuator/bell crank arrangement is mounted at the other end of bucket 32 and tine assembly 33. Also, if desired, only one hydraulic actuator/bell crank arrangement may be utilized.

In operation, with hydraulic actuator 41 being mounted to bucket 32, actuation thereof changes the position of bell crank assembly 50, which in turn changes the position of hydraulic actuator 42 and tine assembly 33, whereby actuation of hydraulic actuator 42 enables the tine assembly 33 to open to a near full position relative to bucket 32 (as shown in FIGS. 3A–3B and 4A–4B) as described in greater detail hereinafter.

Figure 3A:
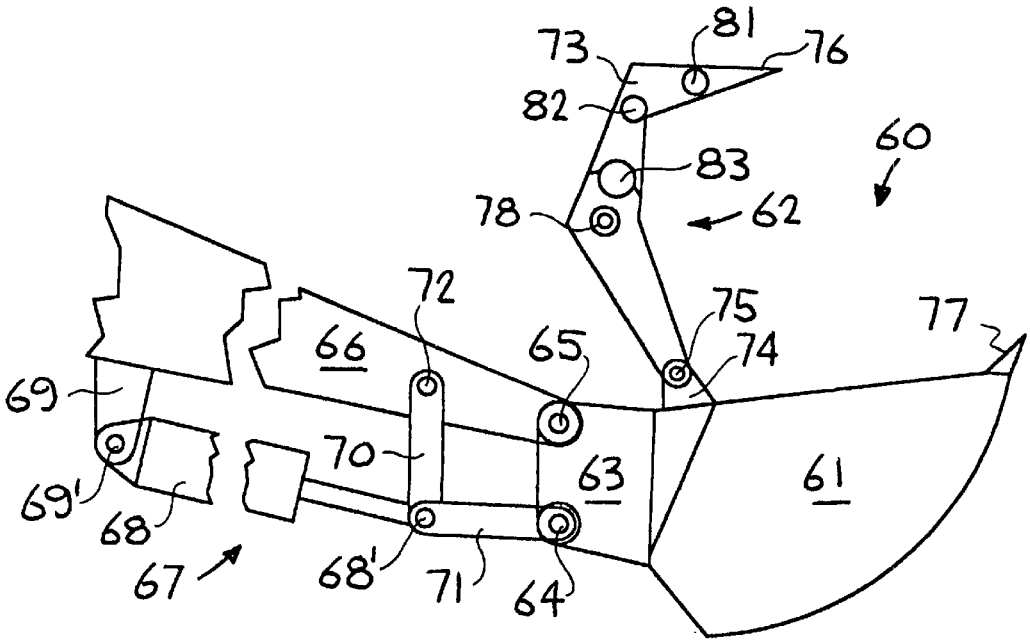
FIGS. 3A and 3B schematically illustrate the single actuator/coupling assembly mounting the improved bucket assembly to a boom or dipper stick of a piece of equipment with the grapple-like tine assembly of the bucket assembly being shown in full open and full closed positions.
Figure 3B:
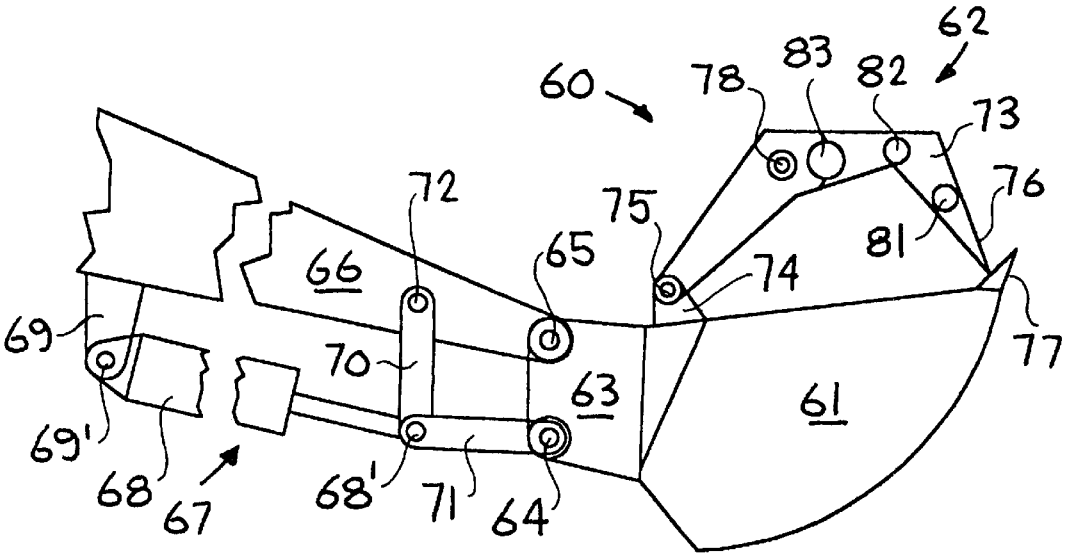
Figure 4A:
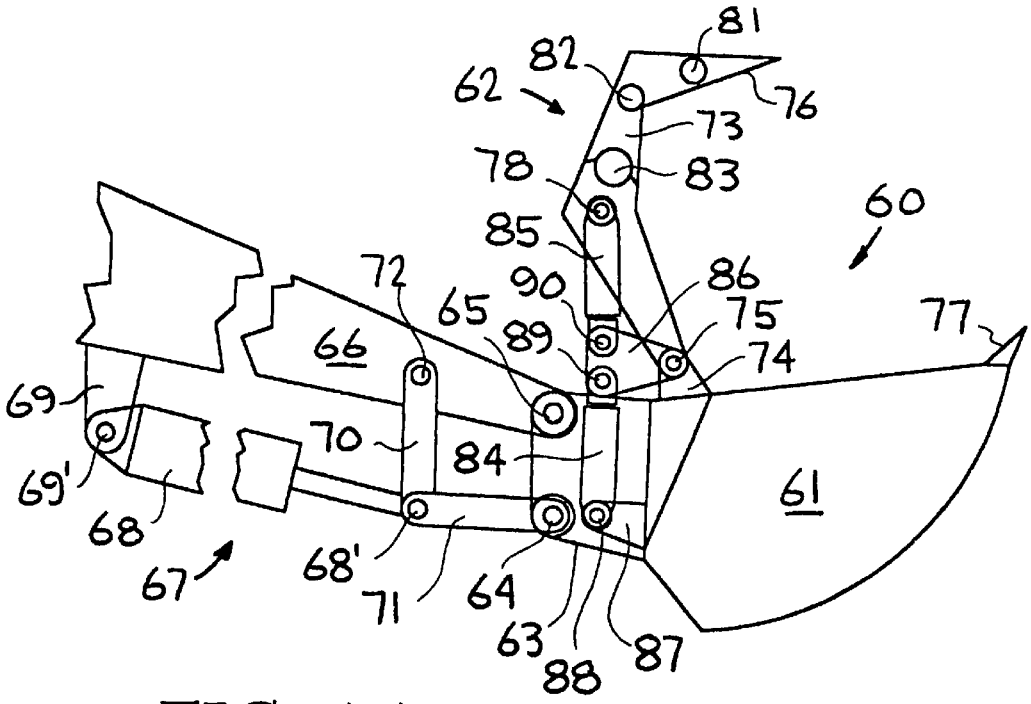
FIGS. 4A and 4B schematically illustrate the apparatus of FIGS. 3A and 3B with a pair of hydraulic actuators and a free floating bell crank connecting the bucket and the tine assembly.
Figure 4B:
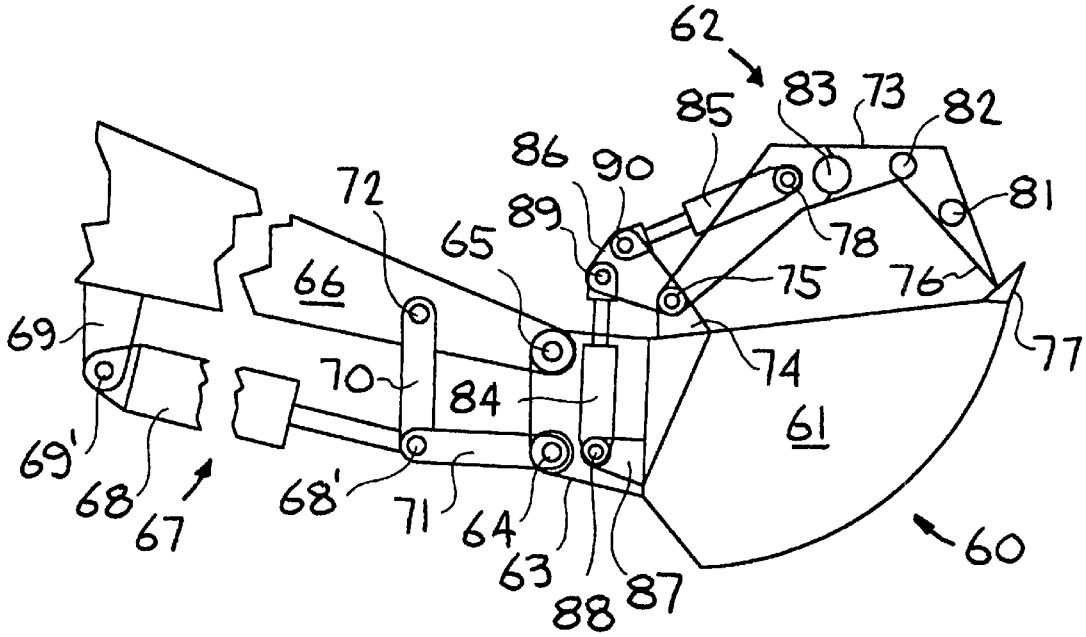
Figure 5:
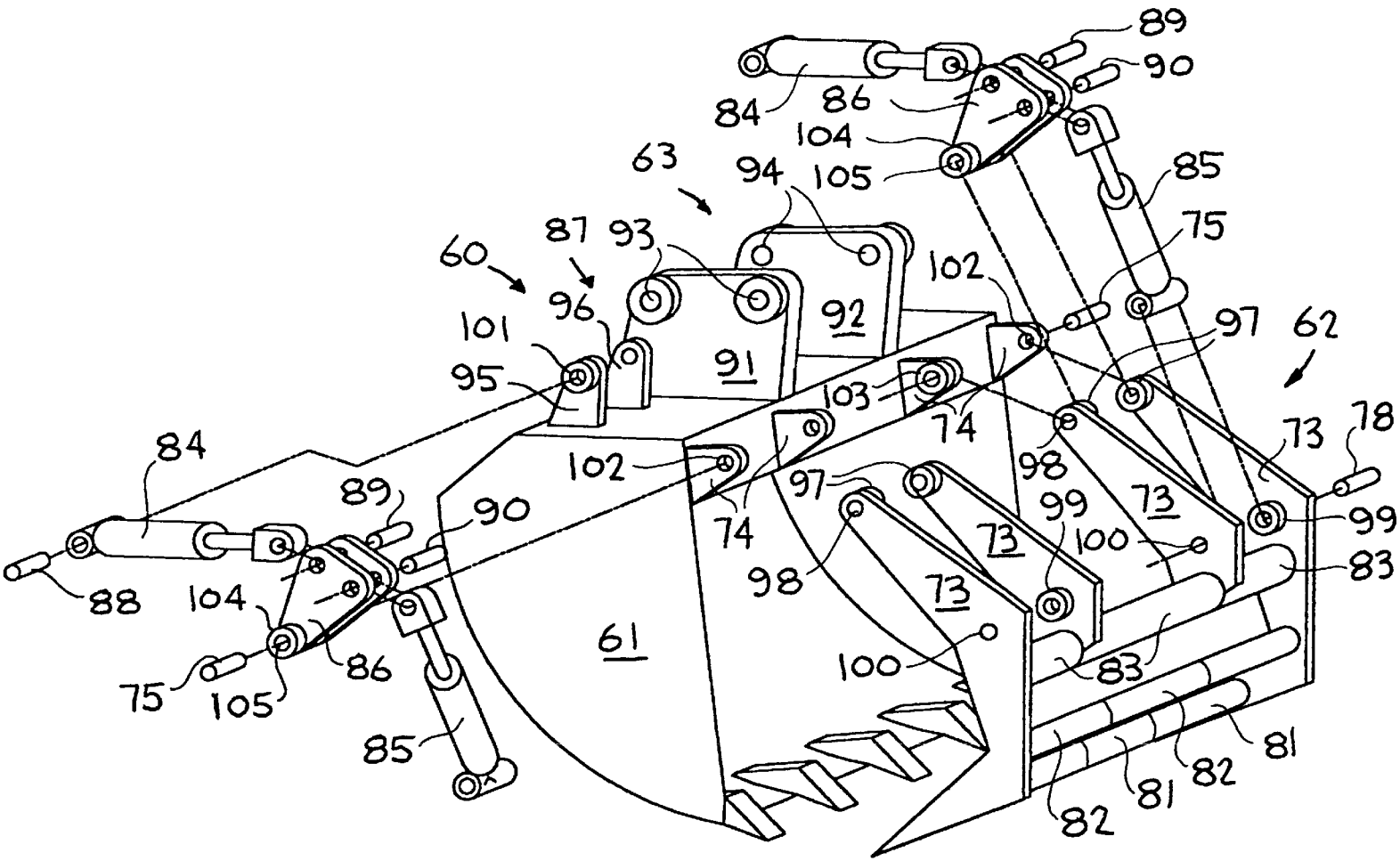
FIG. 5 is a partial, exploded view of another embodiment of the improved bucket assembly which includes two pair of hydraulic actuators and two bell cranks.
Figure 6:
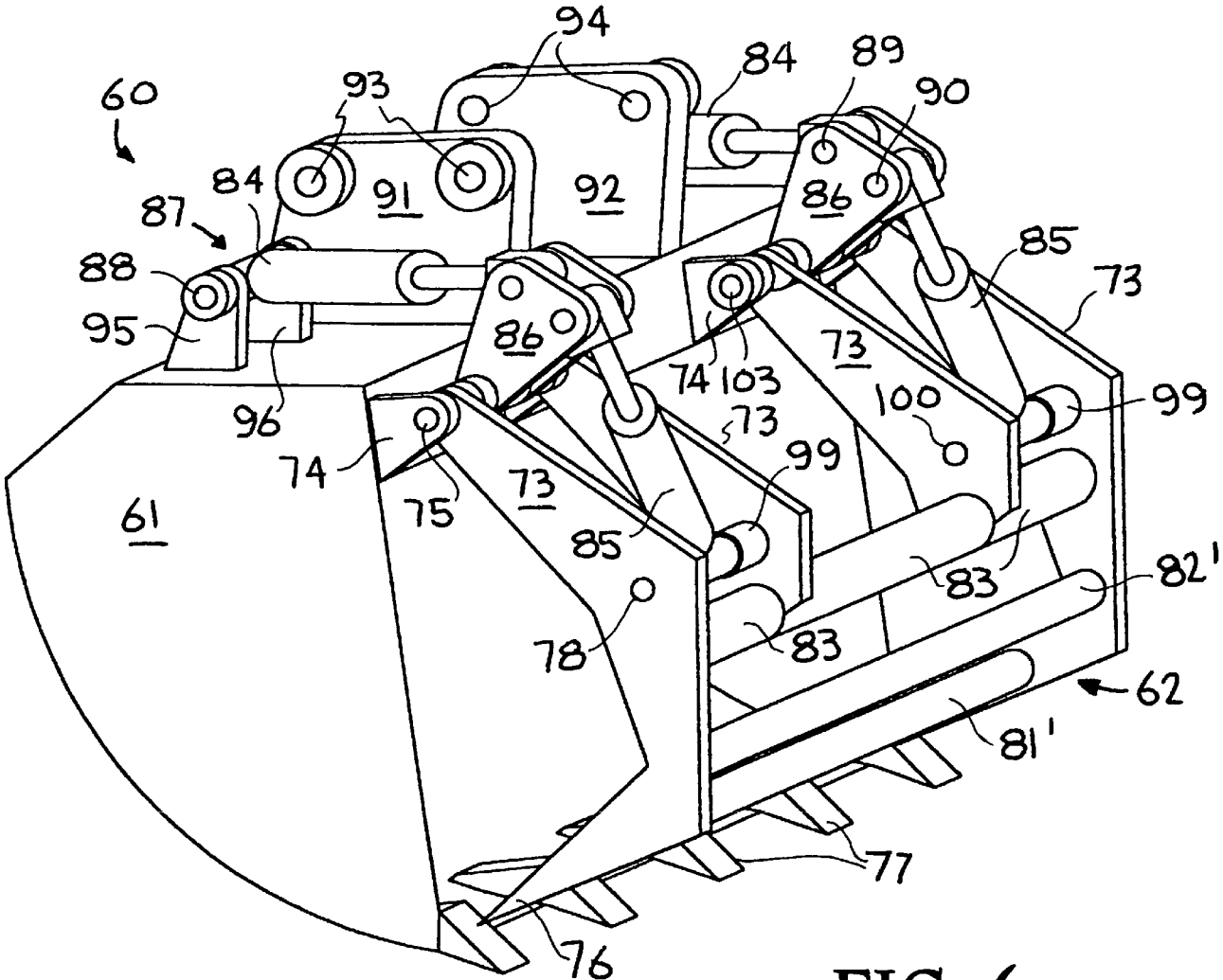
FIG. 6 illustrates the embodiment of FIG. 5 (with components omitted for clarity) in its fully closed position and illustrating the location of all the components of the improved bucket assembly.

FIGS. 3A–3B and 4A–4B illustrate an embodiment of the improved bucket assembly generally similar to that of FIG. 2 and the mounting thereof to a boom of a machine such as a backhoe of excavator, with FIGS. 4A–4B illustrating the hydraulic actuators for the bucket/tine assembly. FIGS. 3A and 4A show the tine assembly in an open position relative to the bucket. As shown, the improved bucket assembly (generally indicated at 60) includes a bucket 61, a grapple-like tine assembly 62 and a double pin mounting structure 63 having removable pins 64 and 65, with pin 65 being pivotably mounted to a boom or dipper stick 66 and pin 64 pivotably mounted to an actuator/linkage assembly 67. As discussed above, the use of a single actuator/linkage assembly instead of dual assemblies commonly used in the prior art enables a wider movement or rotation of the bucket assembly 60 than can be had with a dual actuator/linkage assembly. Actuator/linkage assembly 67 comprises a hydraulic actuator 68 pivotably mounted at one end via a connector member 69 and pin 69' to boom 66 and pivotably mounted at the opposite end to ends of a pair of links or members 70 and 71 via a pin 68' with link 70 pivotably mounted at an opposite end via a pin 72 to boom 66, and with link 71 pivotably connected at the opposite end to pin 64 of mounting structure 63. Thus, activation of actuator 68 causes pivotable movement of bucket assembly 60 about pin 65 and boom 66. Grapple-like tine assembly 62 includes a plurality of tines 73 (four in this embodiment as seen in FIGS. 5 and 6) which are pivotably mounted to bucket 61 via a connector 74 and pin 75. Each of tines 73 of tine assembly 62 includes a tip 76 which, when in a closed position (as shown in FIG. 3B), is located intermediate a pair of tips 77 on bucket 61, with bucket 61 including five tips 77 in this embodiment (as seen in FIG. 6). Tines 73 are each provided with a pin 78 to which a hydraulic actuator is pivotably mounted (as shown in FIGS. 4A–4B). Also, tines 73 of tine assembly 62 is provided with spacers or members 81, 82 and 83 (as seen in FIGS. 5 and 6).

FIGS. 4A–4B illustrate the improved bucket assembly of FIGS. 3A–3B with hydraulic actuators for the grapple-like tine assembly 62, and thus corresponding components are given like reference numerals. As seen in FIGS. 4A and 4B, a pair of hydraulic actuators 84 and 85 are interconnected via a bell crank 86 to bucket 61 and tine assembly 62. Actuator 84 is pivotably mounted at one end via a connector 87 and pin 88 to bucket 61 and mounted pivotably at the opposite end to a leg or segment of bell crank 86 via pin 89. Actuator 85 is pivotably mounted at one end via pin 90 to a leg or segment of bell crank 86 and pivotably mounted at the opposite end to tine assembly 62 via pin 78. Bell crank 86 is pivotably mounted to bucket' 61 via connector 74 and pin 75. Thus, actuation of hydraulic actuators 84 and 85 via the bell crank 86 enables positioning of the tine assembly 62 relative to bucket 61 at any position from a fully open position (seen in FIG. 4A) to a fully closed position (seen in FIG. 4B).

FIG. 5 is a partial, exploded view of the embodiment of the improved bucket assembly of FIGS. 3A–3B and 4A–4B illustrating the mounting of the free floating bell crank assemblies and the mounting of the tines of the grapple-like tine assembly to the bucket. Corresponding components of FIG. 5 to those of FIGS. 4A–4B are given corresponding reference numerals. Bucket 61 attaches to the double pin mounting structure (generally indicated at 63) composed of a pair of spaced plates 91 and 92 which are welded or otherwise secured to bucket 61 and in which are pairs of spaced openings 93 and 94 through which mounting pins 64 and 65 are removably located. Bell crank assemblies 86 are pivotably mounted via pins 75 intermediate adjacent pairs of connectors 74 mounted on bucket 61. Hydraulic actuators 84 are pivotably mounted at one end to bell crank assemblies 86 via pins 89 and to a connector 87 (only one shown) composed of members 95 and 96 via pin 88. Hydraulic actuators 85 are pivotably mounted at one end to bell crank assemblies 86 via pins 90 and intermediate a pair of tines 73 via pins 78 (only one shown). Each of the four tines 73 include a bushing or bearing 97 in openings 98 at the ends thereof for connection to the connectors 74 by pins 75 and bushings or bearing 99 (only 2 shown) in openings 100 in tines 73 for mounting of hydraulic actuators 85 to the tines via pins 78. Members 95 and 96 of connector 87 are provided with bushings or bearings in openings 101 there (only one shown) into which pins 88 extend. Each of connectors 74 include openings 102 and bushings or bearings 103 (only one shown) through which pins 75 extend. Bell cranks 86 include bearings or bushings 104 in openings 105. In FIG. 5, a lower portion of the two center tines 73 have been omitted for clarity to illustrate spaces or members 81, 82 and 83 positioned intermediate adjacent pairs of tines 73. For certain applications, the lower portions of the two central tines 73 may be omitted (as shown in FIG. 6) to enable use of only the two outer tines 73.

FIG. 6 illustrates the improved bucket assembly of FIG. 5 in assembled form and with the lower portions of the two central tines of the grapple-like tine assembly omitted. In the embodiment of FIG. 6, compared to the embodiment of FIG. 2, the housings covering the hydraulic actuators have been omitted and the configuration of the double pin mounting structure changed along with the configuration of the tines. However, the operation of the FIGS. 2 and 6 embodiments are the same. In addition, as set forth above, in FIG. 6 one set of hydraulic actuators and one bell crank assembly may be omitted. Since the components of FIG. 6 are the same as in FIG. 5, like reference numerals are utilized with the only principal difference therebetween being that the bucket and the grapple-like tine assembly are shown in their fully closed position and the multiple spacers or members 81 and 82 of FIG. 5 are shown in FIG. 6 as being single spacers 81' and 82'.

FIGS. 7 and 8 illustrate a hydraulic control system for the embodiments of FIGS. 2 and 6, with FIG. 7 being directed to a single pair of hydraulic actuators (as discussed above), and FIG. 8 directed to the two sets or pairs of actuators (as shown in FIG. 6). Components in FIGS. 7 and 8 corresponding to components in FIG. 6 are given corresponding reference numerals. The hydraulic systems of FIGS. 7 and 8 enable control of the grapple-like tine assembly by a single control lever in the operator's compartment independent of the controls for the boom or the bucket. The control system of each of FIGS. 7 and 8 (generally indicated at 108 and 108') include a source of fluid pressure comprising a fluid reservoir 110 connected by a conduit 111 to a hydraulic pump 112. Fluid pressurized by the pump is directed by conduit 113 into a flow control valve 114 having a spool 115 which is moved axially between positions by a control 116. A first conduit 118 leading from the control valve 114 is coupled with conduits 119 and 120 which are connected to rod ends 121 of hydraulic actuators 84 and 85. In FIG. 8, the first conduit 118 is also connected via conduits 122, 123 and 124 to the rod ends 121 of the second pair of hydraulic actuators 84 and 85. A second conduit 125 leading from the control valve 114 is connected to conduits 126 and 127 to the head ends 128 of hydraulic actuators 84 and 85. In FIG. 8, the conduit 125 is additionally connected via conduits 129, 130 and 131 to the head ends 128 of the second pair of hydraulic actuators 84 and 85. The control 116 can be operated by a push button, for example, on a control stick (not shown) in the operator's compartment used to control the hydraulic actuator 68 on the boom or dipper stick 66 of FIG. 4A–4B. To close the grapple-like tine assembly (as shown in FIGS. 4B and 6), the control 116 is operated to move spool sector 132 into alignment with conduits 118 and 125 so that fluid is directed via conduit 125, etc. into the cylinder head ends 128 of the actuators 84 and 85 for extending the rods thereof (as seen in FIGS. 4B and 6). Return fluid from the rod ends 121 is directed back to the reservoir through conduit 118. When the control 116 is actuated to bring spool sector 133 into alignment with conduits 118 and 125, pressurized fluid is directed via line 118, etc. to the rod ends 121 of the actuators 84 and 85 for retracting the rods of the actuators, where return fluid from the head ends 128 of the actuators is directed back to the reservoir 110 via conduit 125. The neutral position is when the control 116 moves spool sector 134 into alignment with conduits 118 and 125 so that pressurized fluid from pump 112 is recycled (as indicated by arrow 135) back to reservoir 110.

The grasping force of the bucket/grapple is activated by the accessory control valve in the equipment operator's compartment, which is separate from the bucket attitude single actuator control. The grasping force of the bucket/grapple, once applied, is not interrupted or lessened by movement of the bucket position.

The bucket/grapple assembly mounting structure enables the dipper stick or boom to be clean and unobstructed while other tools are mounted on the equipment. If the equipment is equipped with a quick coupling device (available in the industry), the bucket/grapple assembly can be dismounted without removal of any pins, just disconnect hydraulic conduits which supply fluid to the actuators of the bucket/grapple assembly.

It has thus been shown that the present invention provides an improved bucket assembly which includes a grapple-like tine assembly mounted to the bucket assembly and controlled by one or two pairs of hydraulic actuators whereby the tine assembly may be controlled to position same in various locations relative to the bucket from a full open position to a fully closed position. The bucket assembly is attached to the boom of a machine via a single actuator/linkage assembly whereby the bucket assembly has a greater movement or swing compared to equipment utilizing two actuator/linkage assemblies on the boom.

While particular embodiments have been illustrated and described, such are not intended to be limiting. Modifications and changes may become apparent to those skilled in the art, and it is intended that the invention be limited only by the scope of the appended claims.

What is claimed is:

1. An improved bucket assembly, consisting of:

a single bucket, a single grapple-like tine assembly pivotally mounted directly to said bucket, at least one actuator pivotally mounted intermediate said bucket and said tine assembly via a bell crank pivotally mounted to said bucket for moving said tine assembly relative to said bucket, and a mounting structure mounted directly to said bucket and adapted to pivotally and removably attach said bucket directly to an associated boom of an associated machine.

2. The bucket assembly of claim 1, wherein said at least one actuator includes at least one pair of actuators, one of said pair of actuators being pivotally mounted to said bucket and to said bell crank, another of said pair of actuators being pivotally mounted to said bell crank and to said tine assembly.

3. The bucket assembly of claim 2, additionally including another pair of pivotally mounted actuators, each pair of actuators being mounted at opposite ends of said bucket and tine assembly via another bell crank.

4. The bucket assembly of claim 3, additionally including a housing mounted to cover each of said actuators.

5. The bucket assembly of claim 4, wherein said mounting structure is of a double pin type having removable pins, said mounting structure being located intermediate housings covering said actuators mounted to said bucket.

6. The bucket assembly of claim 1, wherein said mounting structure comprises a pair of members secured to said bucket, and a pair of spaced removable pins mounted in said pair of members.

7. The bucket assembly of claim 1, wherein said tine assembly includes a plurality of tines and at least one spacer member located intermediate each pair of tines.

8. The bucket assembly of claim 1, in combination with an actuator/linkage assembly adapted to be mounted to an associated boom of an associated machine on which said bucket assembly is removably mounted and pivotally connected to said mounting structure.

9. The combination of claim 8, wherein said actuator/linkage assembly comprises a single actuator having one end adapted to be pivotally mounted to such an associated boom and an opposite end pivotally connected to a linkage assembly, said linkage assembly including members having one end pivotally connected to such an associated boom and pivotally connected to said mounting structure.

10. The combination of claim 9, wherein said mounting structure is of a type having two spaced pins and wherein said bucket is adapted to be pivotally mounted to such an associated boom via one of said two spaced pins, and wherein said linkage assembly is pivotally connected to another of said two spaced pins.

11. In a bucket assembly for use on an end of a boom of a machine, the improvement consisting of:

a single bucket adapted to be pivotally mounted directly to an associated boom, a single grapple-like tine assembly pivotally mounted directly to said bucket, and at least one pair of actuators pivotally mounted to said bucket and to said tine assembly via a bell crank assembly pivotally mounted to said bucket for controllably moving said tine assembly relative to said bucket.

12. The improvement of claim 11, additionally includes a second pair of actuators mounted to said bucket and to said tine assembly via another bell crank assembly mounted to said bucket.

13. The improvement of claim 12, additionally including a housing cover in each of said actuators.

14. The improvement of claim 12, wherein each of said actuators comprises a hydraulic actuator.

15. The improvement of claim 11, additionally including a housing covering each of said actuators.

16. The improvement of claim 11, wherein each of said actuators comprises a hydraulic actuator.

17. The improvement of claim 11, additionally including a double pin mounting structure mounted thereto.

18. The improvement of claim 17, wherein said mounting structure is adapted to be pivotally connected directly to an associated boom and adapted to be pivotally connected to an actuator/linkage assembly, said actuator/linkage assembly being adapted to be pivotally connected to such an associated boom.

19. The improvement of claim 18, wherein said actuator/linkage assembly comprises a single hydraulic actuator and a plurality of interconnected linkage members pivotally connected at one end to one end of said hydraulic actuator and at an opposite end to said mounting structure and to such an associated boom.

20. A tool assembly for use on an end of a boom of a machine, consisting of:

a single bucket, and a single tine assembly, said bucket being adapted to be pivotally mounted directly to an associated boom, said tine assembly being pivotally mounted only to said bucket, at least one actuator pivotally mounted intermediate said bucket and said tine assembly via an assembly pivotally mounted to said bucket for moving said tine assembly relative to said bucket, and at least one actuator adapted to be pivotally mounted intermediate said bucket and such an associated boom for simultaneously moving said bucket and said tine assembly.

* * * * *